US010657930B2

(12) United States Patent
Miura

(10) Patent No.: US 10,657,930 B2
(45) Date of Patent: May 19, 2020

(54) TOPBOARD REFLECTION PREVENTER FOR GRAND PIANO

(71) Applicant: KABUSHIKI KAISHA KAWAI GAKKI SEISAKUSHO, Hamamatsu-shi, Shizuoka-ken (JP)

(72) Inventor: Hirohiko Miura, Hamamatsu (JP)

(73) Assignee: KABUSHIKI KAISHA KAWAI GAKKI SEISAKUSHO, Hamamatsu-shi, Shizuoka (JP)

( * ) Notice: Subject to any disclaimer, the term of this patent is extended or adjusted under 35 U.S.C. 154(b) by 0 days.

(21) Appl. No.: 16/432,759

(22) Filed: Jun. 5, 2019

(65) Prior Publication Data

US 2019/0378479 A1 Dec. 12, 2019

(30) Foreign Application Priority Data

Jun. 8, 2018 (JP) ..... 110482/2018

(51) Int. Cl.
*G10C 3/02* (2006.01)
*G10C 1/04* (2006.01)

(52) U.S. Cl.
CPC ..... *G10C 3/02* (2013.01); *jG10C 1/04* (2013.01)

(58) Field of Classification Search
CPC ..... G10C 3/02; G10C 1/04; G10C 9/00
See application file for complete search history.

(56) References Cited

FOREIGN PATENT DOCUMENTS

JP 57-195188 U 12/1982
WO W02018080391 A1 * 5/2018 ..... G10C 1/04

* cited by examiner

*Primary Examiner* — Kimberly R Lockett
(74) *Attorney, Agent, or Firm* — Lewis Roca Rothgerber Christie LLP

(57) ABSTRACT

A topboard reflection preventer for a grand piano, which is capable of positively preventing lighting from being reflected by an open topboard, while maintaining excellent appearance of a piano body. The topboard reflection preventer for a grand piano is attached to an openable and closable topboard formed by a topboard rear and a topboard front, and prevents lighting from above from being reflected by the topboard in a state of the topboard held open in an inclined position. The topboard reflection preventer includes a reflection preventer body attached to the topboard rear and the topboard front folded onto the topboard rear, in a state covering whole upper surfaces of the topboard rear and the topboard front, and a holding member for holding the reflection preventer body so as to prevent the reflection preventer body from falling off the topboard held open in the inclined position.

7 Claims, 6 Drawing Sheets

TOPBOARD REFLECTION PREVENTER FOR GRAND PIANO

CROSS-REFERENCE TO RELATED APPLICATION(S)

This application claims priority to Japanese Patent Application Number 110482/2018, filed on Jun. 8, 2018, the entire contents of which are incorporated herein by reference

BACKGROUND OF THE INVENTION

Field of the Invention

The present invention relates to a topboard reflection preventer for a grand piano, which is used e.g. when a piano concerto is played with an orchestra in the back, so as to prevent lighting from being reflected by an open topboard of a grand piano.

Description of the Related Art

A general grand piano has an outer peripheral surface painted black and gloss-coated. Specifically, portions, including a fallboard, an outer rim, and a topboard, which are visible from the outside are mostly gloss-coated. In particular, the topboard as a top board of the grand piano has not only an upper surface thereof but also a lower surface thereof gloss-coated because the lower surface can be seen from the outside while the topboard is held open. In general, the topboard is comprised of a topboard rear having a predetermined shape and a topboard front having a laterally elongated rectangular shape and connected to the front end of the topboard rear via hinges. When opening the topboard, the topboard front is folded back onto the topboard rear and then the topboard rear is pivotally moved upward along with the topboard front about hinges on a low-pitch range side (i.e. on a left side as viewed from the front of the grand piano), followed by being supported from below by a topboard prop.

When a grand piano having a topboard whose upper and lower surfaces are gloss-coated as mentioned above is used e.g. in a concert where a piano concerto is played with an orchestra in the back, the piano is placed in the center front of a stage, and the topboard of the piano is pivotally moved up toward the rear of the stage, whereby the topboard is held open in a state inclined at an angle of approximately 45 degrees. Further, during the musical performance, a conductor stands right behind the piano and the whole stage is illuminated bright from above by a lighting system installed on the stage ceiling. In a case where the concerto is played in such a state, lighting reflected on the topboard of the piano can get in the eyes of orchestra players who play looking at the conductor and dazzle the players, thereby hindering them from sufficiently looking at the conductor and causing trouble in the musical performance.

To avoid the above-described problem, matte processing is applied to the upper surface of the topboard. In this case, however, the gloss-coated portions, such as the fallboard and the outer rim, and the topboard subjected to the matte processing mixedly exist in the single piano, which causes degradation of the excellent appearance of the piano. Alternatively, a matte coating is applied to the upper surface of the topboard by a spray. However, in this case, it is required to evenly apply the matte coating to the whole of the relatively large topboard and this troublesome work takes much time and labor.

Further, it is envisaged that a grand piano cover disclosed in Japanese Laid-Open Utility Model Publication (Kokai) No. S57-195188 is used so as to avoid the problem mentioned above. This grand piano cover is made of chemical fiber fabric and has a sufficiently large size for covering the whole piano body of the grand piano. The grand piano cover is comprised of three covers, i.e. specifically, a top board cover for covering the topboard rear, a front cover for covering the topboard front and the fallboard, and an outer rim cover for covering the outer rim. The top board cover is configured to cover the whole upper surface of the topboard rear and has left, right, and rear peripheral portions thereof formed such that they expand outward from those of the topboard rear. The front cover is removably attached to the front end of the top board cover via a surface fastener provided on the rear end of the front cover itself.

In the case of the above-described grand piano cover, when opening the topboard, the front cover is removed from the top board cover, and the top board cover alone remains on the topboard. For this reason, when the topboard is opened with the topboard front folded onto the topboard rear, the topboard front is exposed in an uncovered state, and therefore the problem that lighting is reflected on the topboard front is not solved. Further, since the left, right, and rear peripheral portions of the top board cover are largely expand outward from those of the topboard rear, the right peripheral portion of the top board cover (i.e. the upper portion of the top board cover in the opened state of the topboard) hangs down from the edge of the topboard rear, and the hanging portion is seen from the audience side, which degrades the appearance of the piano body.

SUMMARY OF THE INVENTION

It is an object of the present invention to provide a topboard reflection preventer for a grand piano, which is capable of positively preventing lighting from being reflected by an open topboard, while maintaining excellent appearance of a piano body.

To attain the above object, the present invention provides a topboard reflection preventer for a grand piano, which is attached to an openable and closable topboard formed by a topboard rear and a topboard front, so as to prevent lighting from above from being reflected by the topboard in a state in which the topboard is held open in an inclined position, comprising a reflection preventer body configured to be attached to the topboard rear and the topboard front folded onto the topboard rear, in a state covering whole upper surfaces of the topboard rear and the topboard front, and holding means configured to hold the reflection preventer body so as to prevent the reflection preventer body from falling off the topboard held open in the inclined position.

In general, a grand piano has a topboard including a topboard rear having a predetermined shape with a larger depth in a low-pitch range side and a smaller depth in a high-pitch range side, and a topboard front having a laterally elongated rectangular shape and foldably connected to the front end of the topboard rear. Further, when opening the topboard, the topboard front is pivotally moved rearward to be folded onto the topboard rear, and then in this state, the high-pitch range side of the topboard is lifted up, followed by the topboard being supported by a topboard prop, in a state inclined such that the topboard slopes down toward the low-pitch range side. With this, the topboard is held open in a state inclined downward to the left, as viewed from a player. In the topboard reflection preventer of the present invention, which is attached to the topboard of the above-described type, the reflection preventer body is attached to the topboard rear and the topboard front folded onto the topboard rear in a state covering the whole upper surfaces of these. Further, the reflection preventer body attached to the topboard is held by the holding means such that it is prevented from falling off the topboard held open in the inclined position.

When the grand piano is used in a concert where a piano concerto is played with an orchestra in the back, the topboard is pivotally moved up toward the rear of a stage to be held open in a state inclined at an angle of approximately 45 degrees, as described hereinbefore. In this case, the whole upper surfaces of the topboard rear and the topboard front folded onto the topboard rear are covered with the topboard reflection preventer attached to the topboard, and hence even when the whole stage is illuminated bright by a lighting system installed on a stage ceiling, it is possible to positively prevent lighting from being reflected on the topboard, to thereby enable orchestra players to play in a favorable environment without being dazzled. Further, since the holding means for holding the reflection preventer body so as to prevent the same from falling off the inclined topboard is formed by minimum necessary parts so as not to be noticeably seen from an audience side, it is possible to maintain excellent appearance of the piano body. As described above, according to the present invention, it is possible to positively prevent lighting from being reflected by the open topboard, while maintaining the excellent appearance of the piano body.

Preferably, the reflection preventer body is configured to be removably attached to the topboard.

With the configuration of this preferred embodiment, the reflection preventer body is configured to be removably attached to the topboard, so that e.g. in a case where the topboard reflection preventer is provided in a concert hall, when a grand piano is used, as described hereinbefore, in a concert where a piano concerto is played with an orchestra in the back, the topboard reflection preventer is attached to the topboard, whereas when the grand piano is used in a solo concert, the topboard reflection preventer is removed from the topboard, whereby it is possible to hold the concert while maintaining excellent appearance of the piano. Thus, the topboard reflection preventer can be attached to or removed from the grand piano as required.

In a case where the reflection preventer body is made of a sheet-like material such as cloth, for example, and can be folded relatively compact, a piano tuner can carry the topboard reflection preventer with him/her and attach the same to a grand piano tuned by him/her, as required.

Preferably, the reflection preventer body includes a topboard rear cover section configured to cover the upper surface of the topboard rear, and a topboard front cover section integrally formed with the topboard rear cover section and configured to cover the upper surface of the topboard front folded onto the topboard rear.

With the construction of this preferred embodiment, the topboard rear cover section of the reflection preventer body covers the upper surface of the topboard rear, and the topboard front cover section covers the upper surface of the topboard front folded onto the topboard rear. The two covers are integrally formed with each other. The single reflection preventer body having the topboard rear cover section and the topboard front cover section as described above makes it possible to easily cover the whole upper surfaces of the topboard rear and the topboard front folded onto the topboard rear.

More preferably, the topboard rear cover section has a shape substantially same as a shape of the upper surface of the topboard rear, and the topboard front cover section has a shape substantially same as a shape of the upper surface of the topboard front and is formed such that the topboard front cover section is continuous with a right front end of the topboard rear cover section and extends rightward.

With the construction of this preferred embodiment, the topboard front cover section is continuous with the right front end of the topboard rear cover section and extends rightward. For example, when attaching the reflection preventer body made of a sheet-like material to the topboard, first, the topboard rear cover section is placed on the topboard rear such that it is overlaid therewith. Then, the topboard front is pivotally moved rearward to be folded and placed on the topboard rear cover section. Thereafter, the topboard front cover section is folded leftward to be placed on the folded topboard front. With this, the upper surfaces of the topboard rear and the topboard front of the topboard are covered with the topboard rear cover section and the topboard front cover section of the reflection preventer body, respectively. Further, in this case, in a state in which the topboard is held open, the connecting portion between the topboard rear cover section and the topboard front cover section vertically extends around the right end of the topboard front. This makes it possible to prevent the reflection preventer body from sliding leftward and falling off the topboard.

Preferably, the holding means has a holding member which is provided on a periphery of the reflection preventer body such that the holding member extends along the periphery, so as to hold the periphery in a state extending around onto a lower surface of the topboard rear and/or a lower surface of the topboard front.

With the construction of this preferred embodiment, the periphery of the reflection preventer body is held by the holding member in the state extending around onto the lower surface of the topboard rear and/or the lower surface of the topboard front. This holding member is provided on the periphery of the reflection preventer body such that is extends along the periphery, and e.g. when the reflection preventer body is made of a sheet-like material such as cloth and the holding member is made of an expansible material such as rubber, it is possible to easily bring the periphery of the reflection preventer body into the state extending around onto the lower surface of the topboard simply by putting the reflection preventer body on the topboard from above. Further, in a case where the holding member is made of an adhesive material such as adhesive tape, the periphery of the reflection preventer body is affixed to the edge of the lower surface of the topboard via the adhesive material. Thus, it is possible to securely attach the reflection preventer body to the topboard.

Preferably, the holding means has a latch member which is attached to a predetermined portion of the reflection preventer body, and is locked to a locking portion formed on the lower surface of the topboard rear, in a state extending around from above onto the lower surface of the topboard rear.

With the construction of this preferred embodiment, the latch member attached to the predetermined portion of the reflection preventer body is locked to the locking portion on the lower surface of the topboard rear in a state extending around from above to the lower surface of the topboard rear. With this, in a state in which the topboard is held open, it is possible to support the reflection preventer body by the latch member to thereby prevent the reflection preventer body from falling off the topboard. Further, by attaching the latch member to a portion of the reflection preventer body corresponding to a high-pitch range-side portion, which is recessed inward, of the topboard rear (hereinafter referred to as "the curved portion") and locking the same to the locking portion on the lower surface of the topboard rear, it is possible not only to prevent the reflection preventer body from expanding outward from the curved portion of the topboard rear, but also to attach the same to the topboard in a state snugly fitted along the curved portion.

Preferably, the holding means has an adhesive member which has adhesiveness and is provided on one of the reflection preventer body and the topboard so as to hold the reflection preventer body in a state affixed to the upper surface of the topboard rear and/or the topboard front.

With the construction of this preferred embodiment, since the adhesive member having adhesiveness is provided on one of the reflection preventer body and the topboard, it is possible not only to easily affix the reflection preventer body to the upper surface of the topboard rear and/or that of the topboard front via the adhesive member, but also to easily remove the reflection preventer body from the topboard when the reflection preventer body is not required. Further, by forming the reflection preventer body in approximately the same shape in plan view as that of the upper surface of the topboard having the topboard front folded onto the topboard rear, it is possible to snugly affix the reflection preventer body to the upper surface of the topboard. In this case, the reflection preventer body can be completely concealed from an audience.

The above and other objects, features, and advantages of the present invention will become more apparent from the following detailed description taken in conjunction with the accompanying drawings.

BRIEF DESCRIPTION OF THE DRAWINGS

FIGS. 1A and 1B are perspective views useful in explaining a topboard reflection preventer for a grand piano, according to a first embodiment of the present invention, in which FIG. 1A shows a grand piano in a state in which a topboard thereof is closed, and FIG. 1B shows the grand piano in a state in which the topboard having the topboard reflection preventer attached thereto is held open.

FIGS. 3A and 3B are plan views of the topboard reflection preventer according to the first embodiment, in which FIG. 3A shows a whole-topboard cover having a reflection preventer body formed in a cover shape, and FIG. 3B shows a whole-topboard cover having a reflection preventer body formed in a sheet shape.

FIGS. 4A and 4B are front views of the grand piano, which are useful in explaining reflection of lighting by the open topboard, in which FIG. 4A shows the grand piano in a state in which the topboard reflection preventer is not attached to the topboard, and FIG. 4B shows the grand piano in a state in which the topboard reflection preventer is attached to the topboard.

FIGS. 6A and 6B are plan views of the topboard reflection preventer according to the second embodiment, in which FIG. 6A shows a topboard rear cover, and FIG. 6B shows a topboard front cover.

DETAILED DESCRIPTION OF PREFERRED EMBODIMENTS

Figure 1A:
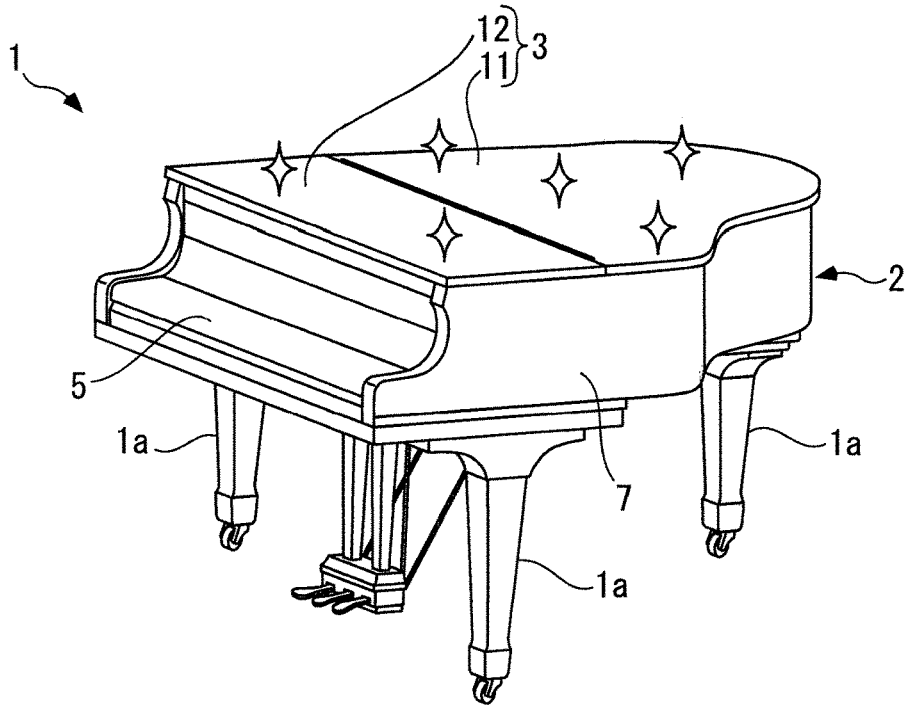
Figure 1B:
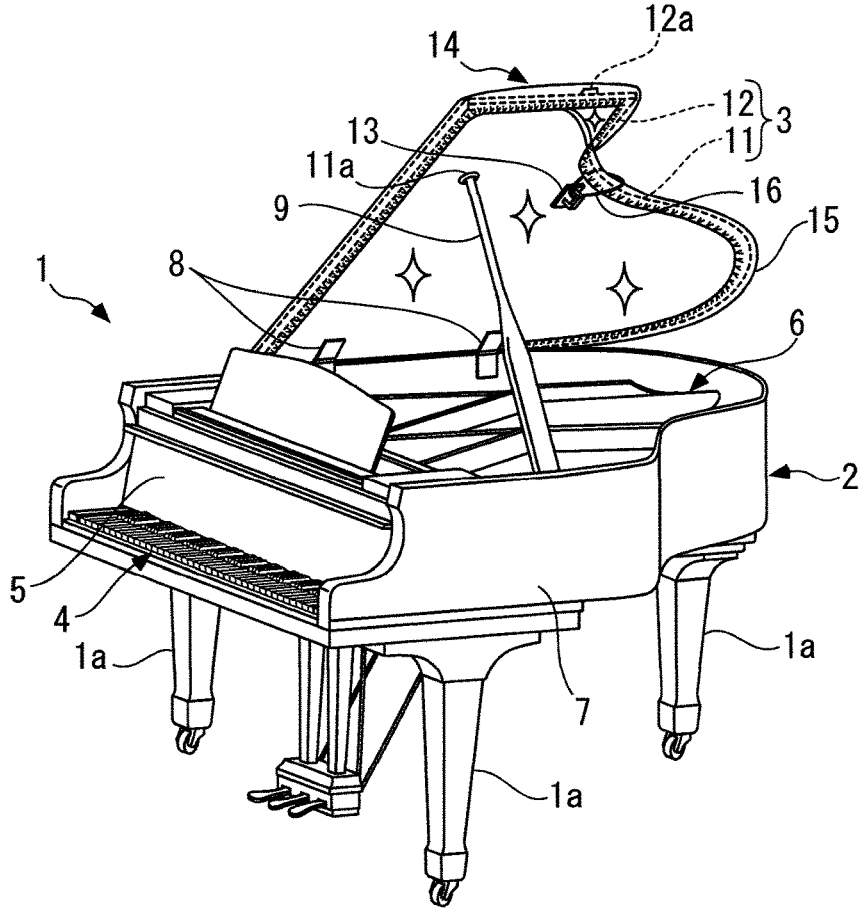

The present invention will now be described in detail with reference to the drawings showing preferred embodiments thereof. FIG. 1A shows a grand piano to which a topboard reflection preventer according to a first embodiment of the present invention is to be attached, and FIG. 1B shows the grand piano in a state in which the topboard is held open with the topboard reflection preventer attached thereto. As shown in FIGS. 1A and 1B, the grand piano 1 is comprised of a piano body 2 supported by three legs 1*a* from below and a topboard 3 that opens and closes the top of the piano body 2. Note that in the following description, a near side, a far side, a left side as a low-pitch range side, and a right side as a high-pitch range side, as viewed from a player who plays the grand piano, of the grand piano will be referred to as "front", "rear", "left", and "right", respectively.

In the front of the piano body 2, there is disposed a keyboard 4 having a plurality of white keys and black keys, each extending in the front-rear direction and arranged side by side in the left-right direction, and above the keyboard 4, there is disposed a fallboard 5 that can be opened and closed. Further, in the rear of the piano body 2, there is provided a frame 6 made of metal and having a predetermined shape, and an outer rim 7 is disposed such that it surrounds the sides of the frame 6. Although not shown, a plurality of strings are stretched on the frame 6 such that they each extend in the front-rear direction, and a plurality of actions are provided below the frame 6 in association with respective keys such that they are arranged side by side in the left-right direction, each for striking an associated one of the strings in accordance with depression of an associated one of the keys.

The outer rim 7 has a predetermined thickness and height and is disposed, as described hereinbefore, such that they continuously surround the left, right, and rear peripheral portions of the frame 6. The topboard 3 is mounted to the left side of the outer rim 7 via a plurality of square hinges 8 such that the topboard 3 can pivotally move about a horizontal axis extending in the front-rear direction. Further, on the right inner surface of the outer rim 7, the base part of a topboard prop 9 having a predetermined length is supported via mounting hardware, not shown, such that the topboard prop 9 can be vertically pivotally moved, and the topboard 3 is held open by the topboard prop 9.

Figure 2A:
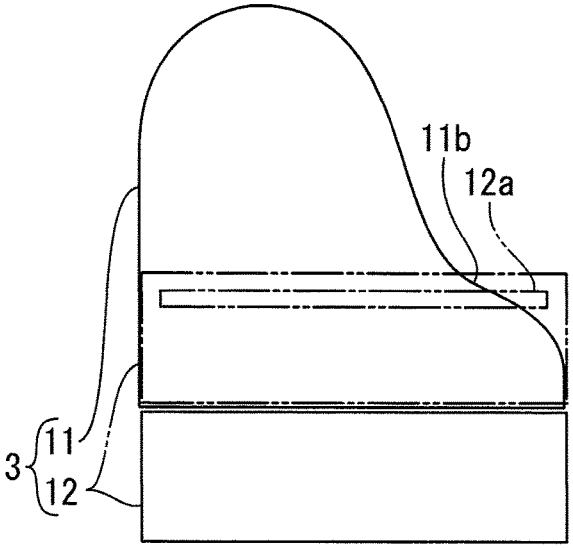
FIG. 2A is a plan view of the topboard.
Figure 2B:
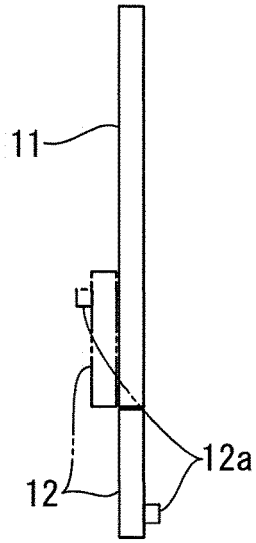
FIG. 2B is a side view of the topboard.

FIGS. 2A and 2B show the topboard 3 in plan view and in side view, respectively. As shown in FIG. 2A and FIGS. 1A and 1B, the topboard 3 has approximately the same shape as that of the outer rim 7 in plan view, and is comprised of a topboard rear 11 formed in a predetermined shape having a larger depth in a low-pitch range side (left side, as viewed in FIG. 2A) and a smaller depth in a high-pitch range side (right side, as viewed in FIG. 2A) and a topboard front 12 formed in a laterally elongated rectangular shape in plan view and connected to the front end of the topboard rear 11 via hinges (not shown) such that the topboard front 12 can be folded rearward. Further, a lock bar 12*a* extending in the left-right direction is protrudingly provided on the front end of the lower surface of the topboard front 12.

When opening the topboard 3, first, the topboard front 12 is pivotally moved rearward to be folded onto the topboard rear 11 (to a state indicated by two-dot chain lines in FIGS. 2A and 2B). In this case, most part of the upper surface of the topboard front 12 overlaps the topboard rear 11, whereas a right front portion of the upper surface of the topboard front 12 is exposed to the outside without overlapping the topboard rear 11. Then, the right end of the topboard rear 11 is lifted up, and the tip of the topboard prop 9 is engaged in a receiving recess 11*a* formed at a predetermined location in the lower surface of the topboard rear 11. With this, the topboard 3 is held open in a position inclined downward to the left at an angle of approximately 45 degrees (see FIG. 1B).

The grand piano 1 constructed as above has most part of its outer surface painted black and gloss-coated. Insofar as the topboard 3 is concerned, not only the upper surface but also the lower surface of the topboard in the closed state thereof is painted black and gloss-coated. In a case where this grand piano 1 is used in a concert in which a piano concerto is played with an orchestra in the back, the grand piano 1 is placed in the center front of a stage, as mentioned hereinbefore, and the topboard 3 is pivotally moved up toward the rear of the stage to be held open in a state inclined at approximately 45 degrees. In this case, a topboard reflection preventer 14 is attached to the topboard 3 so as to prevent the above-described reflection of lighting on the topboard 3.

Figure 3A:
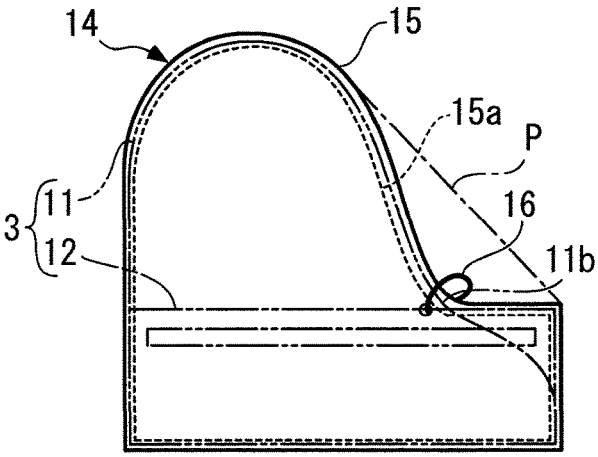

The topboard reflection preventer 14 of the present embodiment covers the whole upper surface of the topboard 3 in a state in which the topboard front 12 is folded onto the topboard rear 11, with a unitary sheet-like member. FIG. 3A shows a whole-topboard cover 15 as a reflection preventer body of the topboard reflection preventer 14. The whole-topboard cover 15 is made of cloth of a predetermined material (e.g. polyester) and has a black color. Note that in the following description, the whole-topboard cover 15 is referred to as "the overall cover 15" as deemed appropriate.

The overall cover 15 has approximately the same shape as that of the upper surface of the topboard 3 and has a size large enough to extend around the periphery of the topboard 3 slightly onto the lower surface thereof. Further, the overall cover 15 has a periphery thereof provided with an expansible holding rubber 15*a* (holding means, holding member) continuously extending along the periphery of the overall cover 15. With this, the overall cover 15 attached to the topboard 3 has its periphery held by the holding rubber 15*a* in a state extending around the periphery of the topboard 3 onto the lower surface thereof, so that even when the topboard 3 is held open in the position inclined downward to the left, the overall cover 15 cannot fall off the topboard 3.

Further, the overall cover 15 is provided with a latch member 16 (holding means) which is locked to a locking portion 13, referred to hereinafter, of the topboard 3. The latch member 16 is a cord-like member having a predetermined length, and is attached to the periphery of the overall cover 15 at a predetermined location, specifically to a portion corresponding to a curved portion 11*b* recessed inward on the high-pitch range side of the topboard rear 11. The latch member 16 extends around the periphery of the topboard 3 onto the back surface of the topboard rear 11 and is locked to the locking portion 13 provided at a predetermined location on the back surface of the topboard rear 11. With this, the overall cover 15 is prevented from expanding outward from the curved portion 11*b* of the topboard rear 11 to a state indicated by a one-dot chain line P in FIG. 3A, and the overall cover 15 is attached to the topboard 11 in a state snugly fitted along the curved portion 11*b* of the topboard rear 11 and the right rear end of the folded topboard front 12. As described above, the overall cover 15 is prevented from falling off the topboard 3 not only by the holding rubber 15*a* but also by the latch member 16. Note that the locking portion 13 may be provided as a new member, or alternatively, it is possible to make use of a topboard latch of an existing locking mechanism for preventing the topboard 3 from being opened by mistake during transport.

Figure 3B:
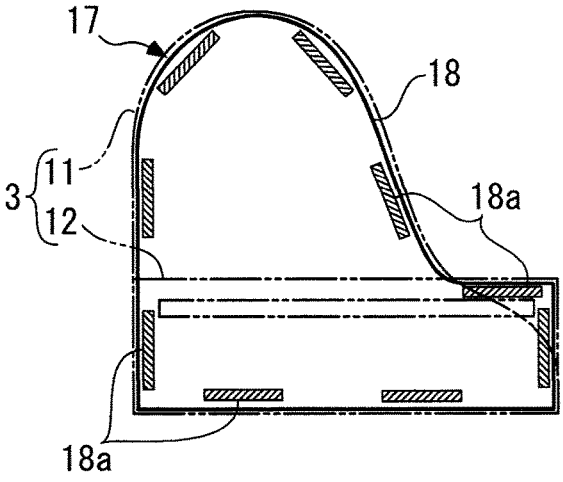

On the other hand, FIG. 3B shows a topboard reflection preventer 17 as a variation of the above-described topboard reflection preventer 14. Similar to the topboard reflection preventer 14, the topboard reflection preventer 17 covers the whole upper surface of the topboard 3 in a state in which the topboard front 12 is folded onto the topboard rear 11, with a unitary sheet-like member, and includes a whole-topboard sheet 18 as an reflection preventer body. The whole-topboard sheet 18 is made of cloth of a predetermined material (e.g. polyester or felt), a thin plate-like panel, or a film of a synthetic resin, and has a black color. Note that in the following description, the whole-topboard sheet 18 is referred to as "the overall sheet 18" as deemed appropriate.

The overall sheet 18 has approximately the same shape and size as those of the upper surface of the topboard 3. Further, on the periphery of the overall sheet 18, there are provided a plurality of (nine in FIG. 3B) adhesive tapes 18*a* (holding means, adhesive members) between the topboard 3 and the overall sheet 18 itself. Each of the adhesive tapes 18*a* is formed e.g. by a double-faced tape and is appropriately affixed to the periphery of the back surface of the overall sheet 18 such that it extends along the periphery, as shown in FIG. 3B. With this, the overall sheet 18 attached to the topboard 3 is held in a state in which its periphery is affixed to the upper surface of the topboard 3 via the adhesive tapes 18*a*.

Note that the adhesive tapes 18*a* are attached in advance to one of the back surface of the overall sheet 18 and the upper surface of the topboard 3. Therefore, when attaching the overall sheet 18 to the topboard 3, the overall sheet 18 is placed and positioned on the topboard 3, and then release paper of each of the adhesive tapes 18*a* is removed, followed by the overall sheet 18 being affixed to the topboard 3 via the adhesive tapes 18*a*.

Figure 4A:
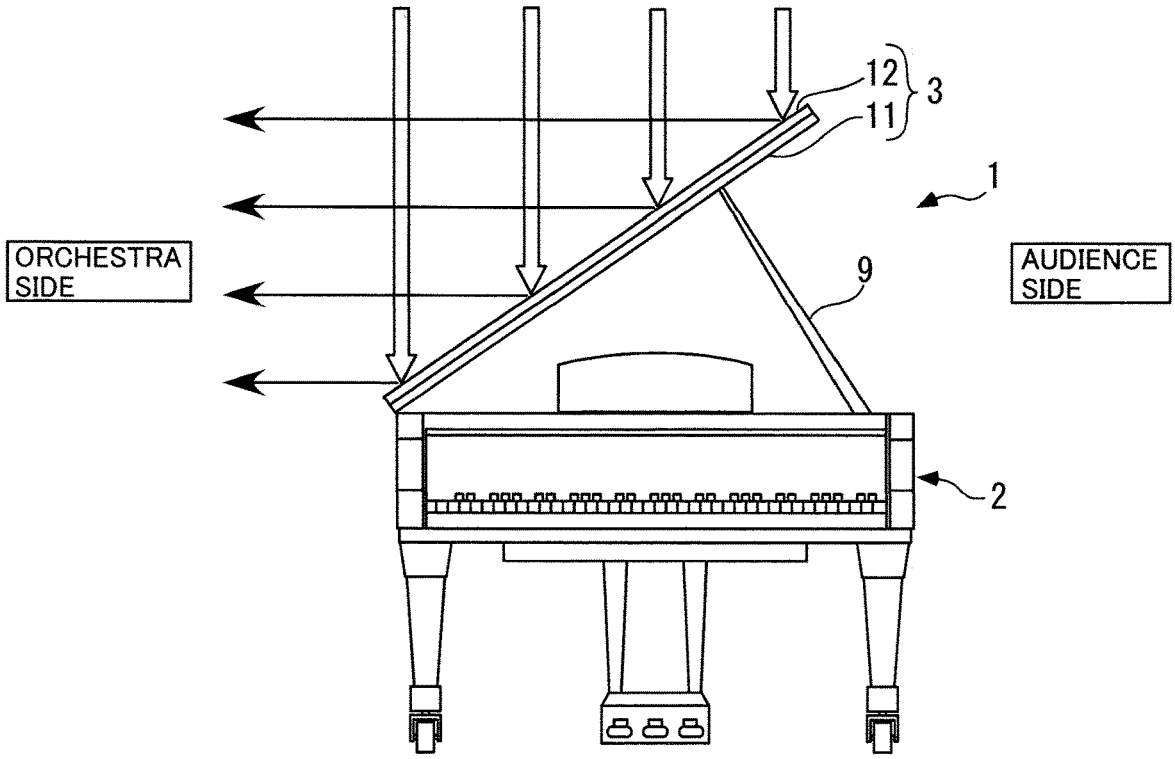

Now, a description will be given, with reference to FIGS. 4A and 4B, of how lighting is reflected by the topboard 3 when the grand piano 1 is being used in a concert where a piano concerto is played with an orchestra in the back. FIG. 4A shows the grand piano 1 in a state in which the topboard reflection preventer 14 or 17 is not attached to the topboard 3. As shown in FIG. 4A, lighting (indicated by white arrows) from above the grand piano 1 is reflected on the upper surface of the topboard 3, or more specifically, on the upper surface of the topboard rear 11 and the upper surface of the topboard front 12 folded onto the topboard rear 11, and reflected light (indicated by black arrows) from the upper surface of the topboard 3 illuminates the orchestra side. In this case, the reflected light gets in the eyes of orchestra players, and therefore the players are dazzled, which can hinder musical performance.

Figure 4B:
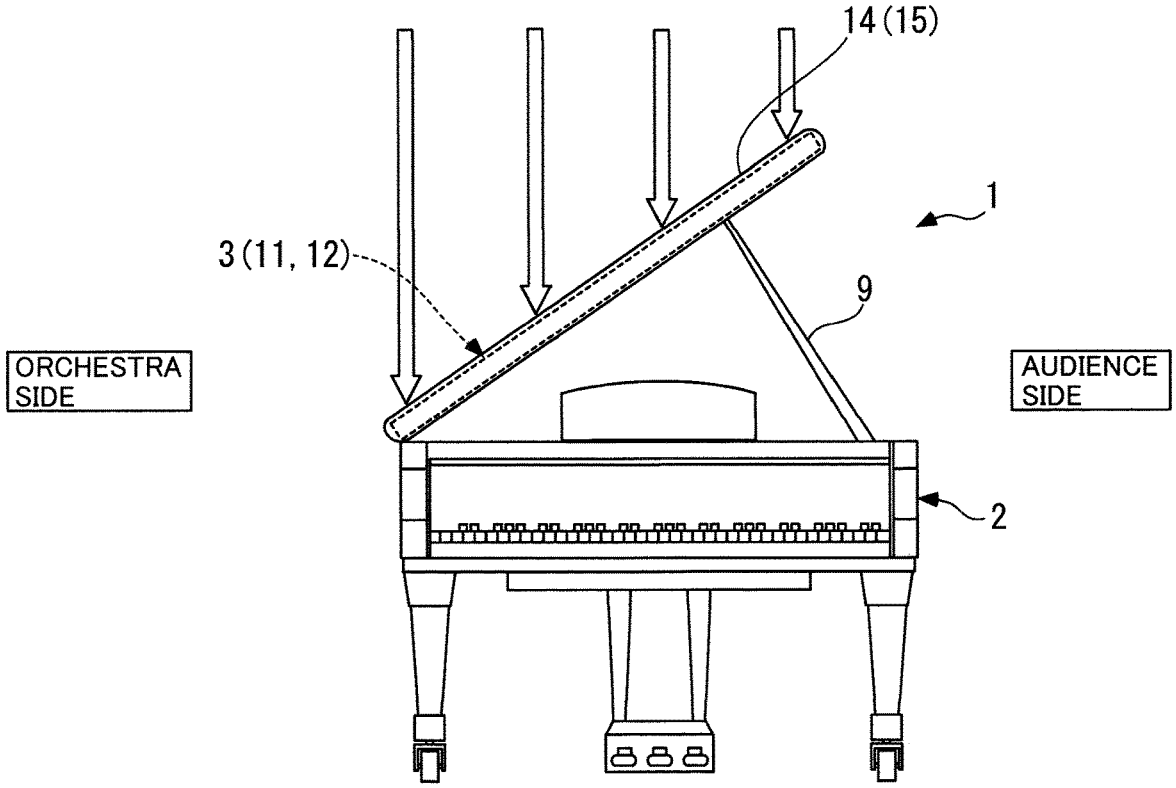

On the other hand, FIG. 4B shows the grand piano 1 in a state in which the topboard reflection preventer (overall cover 15) has been attached to the topboard 3. In this state, as shown in FIG. 4B, reflection of the lighting from above the grand piano 1 is prevented by the topboard reflection preventer 14 attached to the topboard 3, so that differently from the case where the topboard reflection preventer 14 is not attached to the topboard 3 (FIG. 4A), the orchestra side is not illuminated by reflected light of the lighting.

As described above, according to the topboard reflection preventers 14 and 17, when the grand piano 1 is used in a concert where a piano concerto is played with an orchestra in the back, the overall cover 15 or the overall sheet 18 is attached to the topboard 3. Consequently, even when an entire stage is illuminated bright by a lighting system installed on a stage ceiling, since the overall cover 15 or the overall sheet 18 is attached to the topboard 3, it is possible to positively prevent lighting from being reflected on the topboard 3, so that orchestra players can play in a favorable environment without being dazzled.

Further, each of the overall cover 15 and the overall sheet 18 is configured to be removably attached to the topboard 3, and therefore, e.g. when the topboard reflection preventer 14 or 17 is provided in a concert hall, it is possible to attach or remove the topboard reflection preventer 14 or 17 to or from the grand piano 1 as required. Also, e.g. when a piano tuner carries the topboard reflection preventer 14 or 17 with him or her, the topboard reflection preventer 14 or 17 can be attached, as required, to a grand piano tuned by the piano tuner.

Furthermore, the overall cover 15 has the periphery thereof provided with the holding rubber 15*a*, so that it is possible to easily bring the periphery of the overall cover 15 into the state extending around the periphery of the topboard onto the lower surface of the topboard 3 simply by putting the overall cover 15 on the topboard 3 from above, to thereby securely attach the overall cover 15 to the topboard 3. Even when the overall cover 15 is attached to the topboard 3, the back surface of the topboard rear 11 and the most part of the upper surface of the right front end of the topboard front 12 are seen from an audience side, as shown in FIG. 1B. However, since the top and back surfaces of the topboard 3 are both gloss-coated as described hereinbefore, the back surface of the topboard rear 11 and the right front end of the topboard front 12 look lustrous to the audience similar to usual cases. Therefore, the audience looking at the grand piano 1 from their seats do not feel a sense of strangeness.

What is more, since the overall sheet 18 of the topboard reflection preventer 17 has approximately the same shape and size as those of the whole upper surface of the topboard 3 having the topboard front 12 folded onto the topboard rear 11, it is possible to snugly affix the overall sheet 18 to the whole upper surface of the topboard 3. With this, the overall sheet 18 is completely concealed from the audience, which makes it possible to maintain the excellent appearance of the piano body 2.

Figure 5:
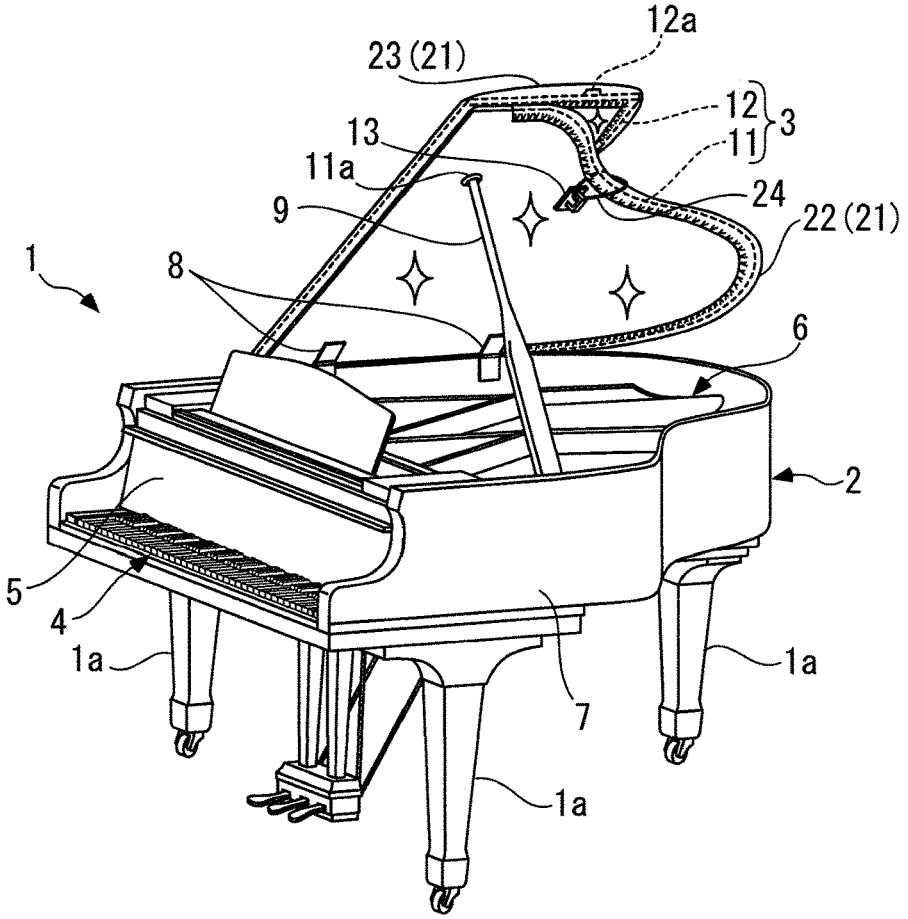
FIG. 5 is a perspective view of a grand piano in a state in which a topboard having a topboard reflection preventer according to a second embodiment of the present invention attached thereto is held open.
Figure 6A:
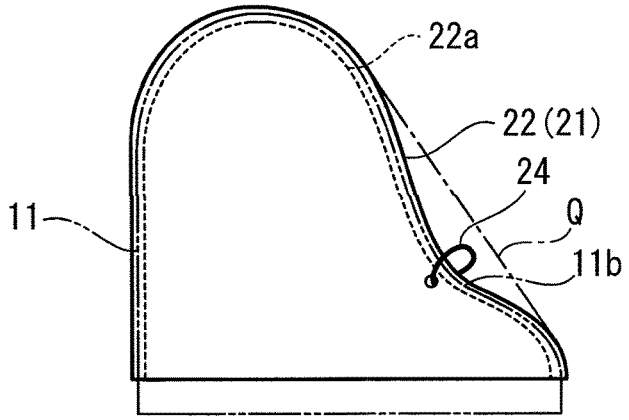
Figure 6B:
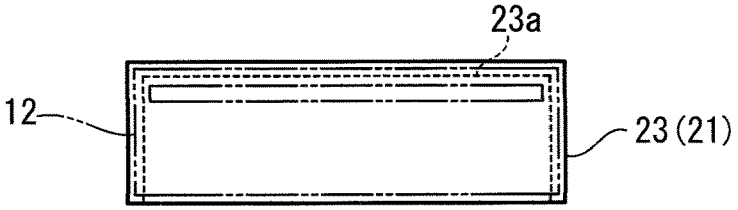

Next, a description will be given, with reference to FIGS. 5, 6A, and 6B, of a topboard reflection preventer 21 according to a second embodiment of the present invention. FIG. 5 shows the grand piano 1 in a state in which the topboard 3 having the topboard reflection preventer 21 attached thereto is held open, and FIGS. 6A and 6B are plan views of the topboard reflection preventer 21. Differently from the above-described topboard reflection preventers 14 and 17 of the first embodiment, which are provided with the overall cover 15 and the overall sheet 18, respectively, the topboard reflection preventer 21 is a type in which the overall cover 15 is divided into a topboard rear cover 22 and a topboard front cover 23.

Note that in the following description, for easy distinction of the topboard reflection preventer 21 of the present embodiment from the above-described topboard reflection preventer 14 of the first embodiment, a modifier "split-type" is added to the topboard reflection preventer 21, and a modifier "unitary-type" is added to the topboard reflection preventer 14, as deemed appropriate.

FIGS. 6A and 6B show the topboard rear cover 22 and the topboard front cover 23, respectively, each of which serves as a reflection preventer body of the topboard reflection preventer 21. Each of the covers 22 and 23 is made of cloth of a predetermined material (e.g. polyester) and has a black color. Note that in the following description, the topboard rear cover 22 and the topboard front cover 23 will be referred to as "the rear cover 22" and "the front cover 23", respectively, as deemed appropriate.

The rear cover 22 has approximately the same shape as that of the upper surface of the topboard rear 11 in plan view and has a size large enough to cover substantially the whole of the upper surface of the topboard rear 11 and extend around the left, right, and rear peripheral portions of topboard rear 11 onto the lower surface thereof. Further, on predetermined portions of the periphery of the rear cover 22, e.g. on left, right, and rear portions of the periphery, there is provided an expansible rear rubber 22*a* (holding means, holding member) continuously extending along these peripheral portions of the rear cover 22. Thus, the rear cover 22 attached to the topboard rear 11 is prevented from falling off the topboard rear 11 even when the topboard 3 is held open in the position inclined downward to the left.

Further, the rear cover 22 is provided with a latch member 24 (holding means) which is locked to the locking portion 13 of the topboard 3. Similar to the latch member 16 of the first embodiment, the latch member 24 is a cord-like member having a predetermined length, and is attached to the periphery of the rear cover 22 at a predetermined location, specifically to a portion corresponding to the curved portion 11*b* of the topboard rear 11. The latch member 24 extends around the periphery of the topboard rear 11 and is locked to the locking portion 13 on the back surface of the topboard rear 11. With this, the rear cover 22 is prevented from expanding outward from the curved portion 11*b* of the topboard rear 11 to a state indicated by a one-dot chain line Q in FIG. 6A, and is attached to the topboard rear 11 in a state snugly fitted along the curved portion 11*b*, whereby the rear cover 22 is prevented from falling off the topboard rear 11 not only by the rear rubber 22*a* but also by the latch member 24.

On the other hand, the front cover 23 has approximately the same shape as that of the topboard front 12 in plan view and has a size large enough to cover the whole upper surface of the topboard front 12 folded onto the topboard rear 11 and extend around the left, right, and rear peripheral portions of the topboard front 12 slightly onto the lower surface of the same. Further, on predetermined portions of the periphery of the front cover 23, e.g. on left, right, and rear portions of the periphery, there is provided an expansible front rubber 23*a* (holding means, holding member) continuously extending along the peripheral portions of the front cover 23. With this, the front cover 23 attached to the topboard front 12 is prevented from falling off the topboard front 12 even when the topboard 3 is held open in the position inclined downward to the left.

Although in the present embodiment, the topboard reflection preventer 21 is comprised of the two covers, i.e. the rear cover 22 and the front cover 23, it is possible to use, in place of the two covers 22 and 23, a topboard rear sheet and a topboard front sheet formed by dividing the overall sheet 18 of the first embodiment in two in association with the topboard rear 11 and the topboard front 12, respectively.

As described above, according to the split-type topboard reflection preventer 21 of the present embodiment, the rear cover 22 and the front cover 23 are attached to the topboard rear 11 and the topboard front 12 of the topboard 3, respectively, whereby it is possible to obtain the same advantageous effects as provided by each of the above-described unitary-type topboard reflection preventers 14 and 17. More specifically, it is possible to positively prevent lighting from being reflected on the topboard 3 to thereby enable orchestra players to play in a favorable environment without being dazzled. Further, since the rear cover 22 and the front cover 23 are configured to be removably attached to the topboard rear 11 and the topboard front 12, respectively, it is possible to attach or remove the two covers 22 and 23 to or from the grand piano 1, as required, similar to the unitary-type topboard reflection preventers 14 and 17 and also secure portability for a piano tuner. Furthermore, the rear cover 22 and the front cover 23 of the split-type topboard reflection preventer 21 are simpler in shape in plan view than the overall cover 15 of the unitary-type topboard reflection preventer 14, and therefore it is possible to manufacture the rear cover 22 and the front cover 23 with relative ease.

Figure 7:
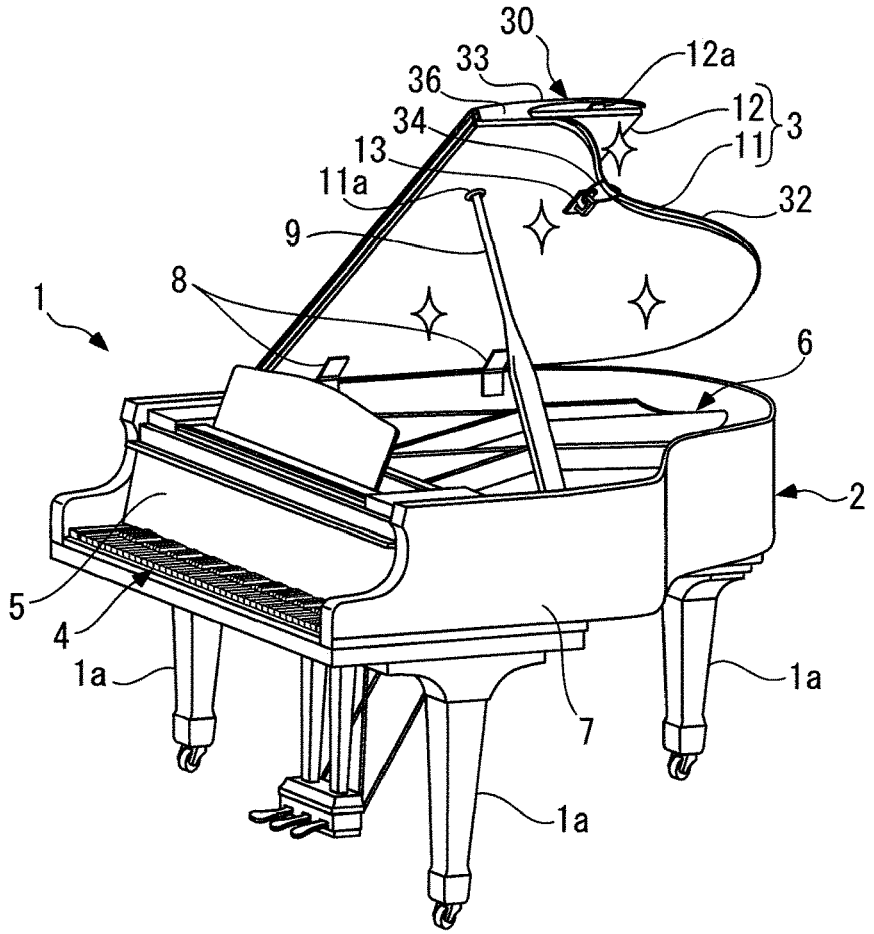
FIG. 7 is a perspective view of a grand piano in a state in which a topboard having a topboard reflection preventer according to a third embodiment of the present invention attached thereto is held open.
Figure 8:
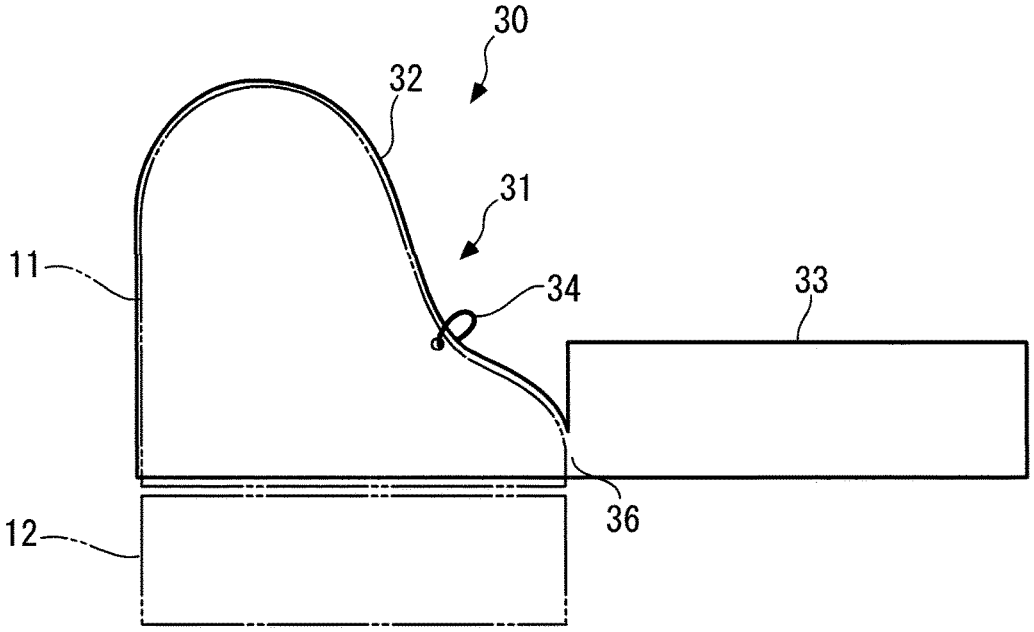
FIG. 8 is a plan view of the topboard reflection preventer according to the third embodiment.

Next, a description will be given, with reference to FIGS. 7 and 8, of a topboard reflection preventer 30 according to a third embodiment of the present invention. FIG. 7 shows the grand piano 1 in a state in which the topboard 3 having the topboard reflection preventer 30 attached thereto is held open, and FIG. 8 is a plan view of the topboard reflection preventer 30. The topboard reflection preventer 30 is comprised of a reflection preventer body 31 for covering the topboard rear 11 of the topboard 3 and the upper surface of the topboard front 12 folded onto the topboard rear 11, and a latch member 34 (holding means) which is locked to the locking portion 13 of the topboard 3.

As shown in FIG. 8, the reflection preventer body 31 has a topboard rear cover section 32 for covering the upper surface of the topboard rear 11 and a topboard front cover section 33 for covering the upper surface of the topboard front 12 folded onto the topboard front 11, and the two cover sections 32 and 33 are integrally formed with each other. The reflection preventer body 31 is made of cloth of a predetermined material (e.g. polyester or felt) and has a black color. Note that in the following description, the topboard rear cover section 32 and the topboard front cover section 33 will be referred to as "the rear cover section 32" and "the front cover section 33", respectively, as deemed appropriate.

The rear cover section 32 has approximately the same shape as that of the topboard rear 11 in plan view, and is formed to cover approximately the whole of the upper surface of the topboard rear 11. Attached to a predetermined location on a right portion of the rear cover section 32 is the latch member 34 which is configured, similar to the latch member 16 of the first embodiment and the latch member 24 of the second embodiment, to be locked to the locking portion 13 on the back surface of the topboard rear 11.

On the other hand, the front cover section 33 has approximately the same shape as that of the topboard front 12 in plan view, i.e. a laterally elongated rectangular shape, and is formed to be continuous with the right front end of the rear cover section 32 and extend rightward.

Figure 9A:
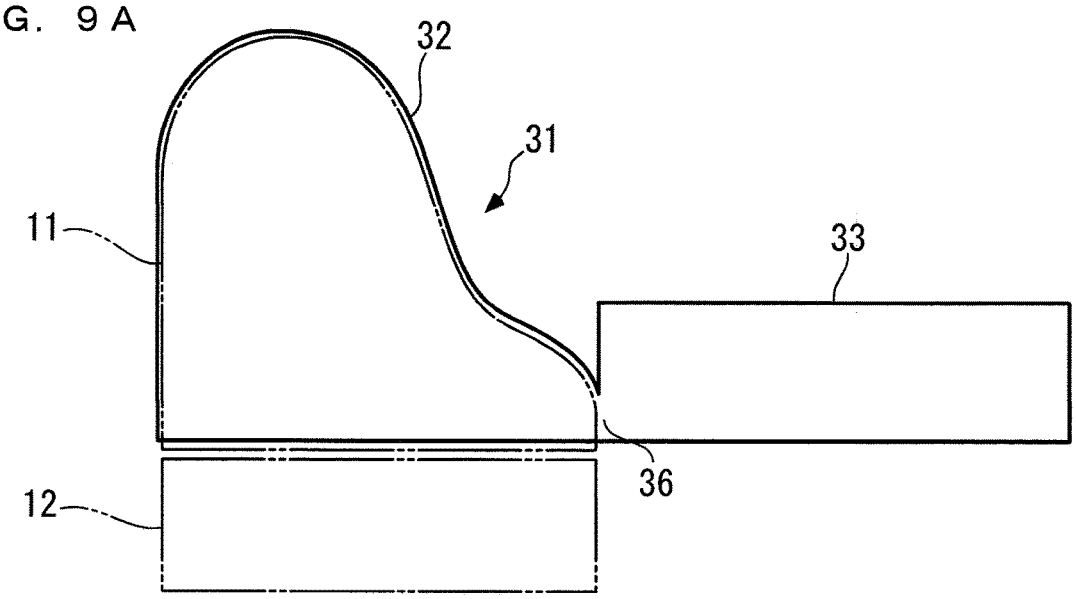
FIGS. 9A to 9C are views useful in explaining a procedure for attaching the topboard reflection preventer of the third embodiment to the topboard.
Figure 9B:
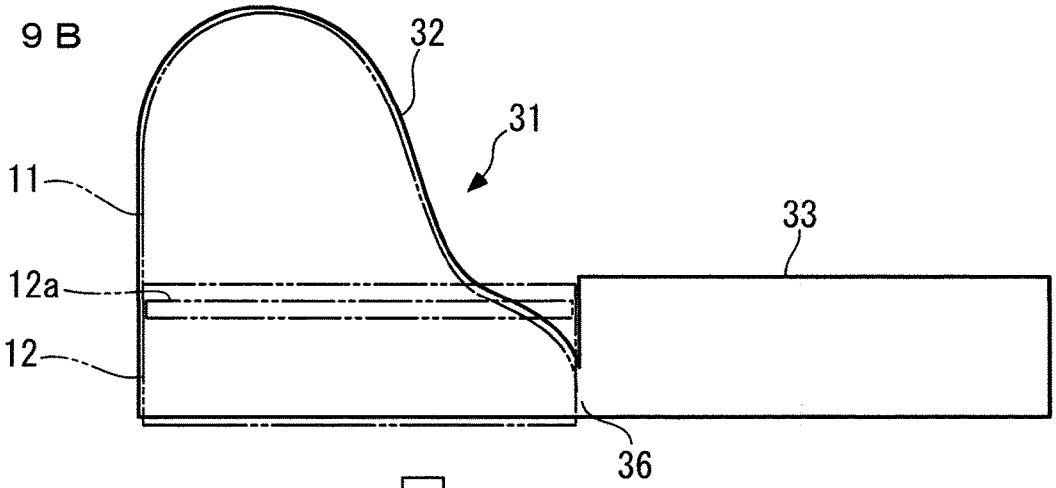
Figure 9C:
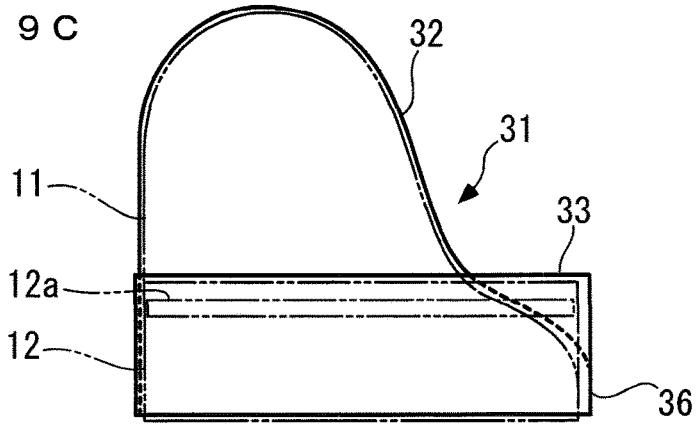

FIGS. 9A to 9C illustrate a procedure for attaching the topboard reflection preventer 30 to the topboard 3. Note that the latch member 34 is omitted from each of FIGS. 9A to 9C. First, as shown in FIG. 9A, the rear cover section 32 of the reflection preventer body 31 is placed on the topboard rear 11 such that it is overlaid therewith. Then, the topboard front 12 is pivotally moved rearward and is folded onto the rear cover section 32, as shown in FIG. 9B. Thereafter, the front cover section 33 of the reflection preventer body 31 is folded leftward onto the folded topboard front 12 as shown in FIG. 9C. With this, the upper surfaces of the topboard rear 11 and the topboard front 12 of the topboard 3 are covered with the rear cover section 32 and the front cover section 33 of the reflection preventer body 31, respectively.

As described above, in the state in which the reflection preventer body 31 is attached to the topboard 3, the latch member 34 is extended around the periphery of the topboard rear 11 onto the lower surface thereof and is locked to the locking portion 13. Then, the right portion of the topboard 3 (the topboard rear 11) is lifted up, and the tip of the topboard prop 9 is engaged in the receiving recess 11*a* formed in the lower surface of the topboard 3. With this, the topboard 3 is held open in the state inclined downward to the left at approximately 45 degrees (see FIG. 7).

As described above, according to the topboard reflection preventer 30 of the present embodiment, it is possible to obtain the same advantageous effects as provided by each of the above-described unitary-type topboard reflection preventers 14 and 17 of the first embodiment and the split-type topboard reflection preventer 21 of the second embodiment. More specifically, it is possible to positively prevent lighting from being reflected on the topboard 3, to thereby enable orchestra players to play in a favorable environment without being dazzled. In a state in which the reflection preventer body 31 is attached to the topboard 3, a connecting portion 36 between the rear cover section 32 and the front cover section 33 is brought into a state vertically extending around the right end of the topboard front 12. Further, the latch member 34 attached to the rear cover section 32 extends around the periphery of the topboard rear 11 onto the lower surface thereof and is locked to the locking portion 13. With this, it is possible to prevent the reflection preventer body 31 from sliding leftward and falling off the open topboard 3. Furthermore, since the reflection preventer body 31 is configured to be removably attached to the topboard 3, it is possible to attach or remove the reflection preventer body 31 to or from the grand piano 1, as required, similar to the unitary-type topboard reflection preventers 14 and 17 of the first embodiment and also secure portability thereof for a piano tuner.

Note that the present invention is not limited to the above-described embodiments, but it can be practiced in various forms. For example, although polyester or felt is mentioned, by way of example, as the material forming the overall cover 15 and the overall sheet 18 of the first embodiment, the rear cover 22 and the front cover 23 of the second embodiment, and the reflection preventer body 31 of the third embodiment, the present invention is not limited to this, but it is possible to adopt any other material insofar as the material can prevent reflection of lighting on the topboard 3. Further, although the overall cover 15 of the first embodiment has the holding rubber 15*a* provided on the periphery thereof and the rear cover 22 and the front cover 23 of the second embodiment have the rear rubber 22*a* and the front rubber 23*a* provide on the respective peripheries thereof, the adhesive tapes 18*a* provided on the overall sheet 18 of the first embodiment may be used in place of the holding rubber 15*a* and the rear rubber 22*a* and the front rubber 23*a*.

Furthermore, although in the split-type topboard reflection preventer 21 of the second embodiment, the rear cover 22 and the front cover 23 are attached to the topboard rear 11 and the topboard front 12, respectively, only one of the rear cover 22 and the front cover 23 may be attached to an associated one of the topboard rear 11 and the topboard front 12.

Moreover, in the reflection preventer body 31 of the third embodiment, it is possible to affix the rear cover section 32 and the front cover section 33 to the respective upper surfaces of the topboard rear 11 and the topboard front 12 using the adhesive tapes 18*a* of the first embodiment. In this case, the latch member 34 can be omitted.

The detailed structure of each of the topboard reflection preventers 14, 17, 21, and 30 is described only by way of example, and it can be modified, as desired, within the scope of the subject matter of the present invention.

It is further understood by those skilled in the art that the foregoing are preferred embodiments of the invention, and that various changes and modifications may be made without departing from the spirit and scope thereof.

What is claimed is:

1. A topboard reflection preventer for a grand piano, which is attached to an openable and closable topboard formed by a topboard rear and a topboard front, so as to prevent lighting from above from being reflected by the topboard in a state in which the topboard is held open in an inclined position, comprising:

a reflection preventer body configured to be attached to the topboard rear and the topboard front folded onto the topboard rear, in a state covering whole upper surfaces of the topboard rear and the topboard front; and holding means configured to hold the reflection preventer body so as to prevent the reflection preventer body from falling off when the topboard held open in the inclined position, wherein the reflection preventer body includes:

a topboard rear cover section configured to cover the upper surface of the topboard rear, and a topboard front cover section integrally formed with the topboard rear cover section and configured to cover the upper surface of the topboard front folded onto the topboard rear, and wherein the topboard rear cover section has a shape substantially the same as a shape of the upper surface of the topboard rear, and wherein the topboard front cover section has a shape substantially the same as a shape of the upper surface of the topboard front and is formed such that the topboard front cover section is continuous with a right front end of the topboard rear cover section and extends rightward.

2. The topboard reflection preventer according to claim 1, wherein the reflection preventer body is configured to be removably attached to the topboard.

3. The topboard reflection preventer according to claim 1, wherein the holding means has an adhesive member and is provided on one of the reflection preventer body and the topboard so as to hold the reflection preventer body in a state affixed to the upper surface of the topboard rear and/or the topboard front.

4. A topboard reflection preventer for a grand piano, which is attached to an openable and closable topboard formed by a topboard rear and a topboard front, so as to prevent lighting from above from being reflected by the topboard in a state in which the topboard is held open in an inclined position, comprising:

a reflection preventer body configured to be attached to the topboard rear and the topboard front folded onto the topboard rear, in a state covering whole upper surfaces of the topboard rear and the topboard front; and holding means configured to hold the reflection preventer body so as to prevent the reflection preventer body from falling off when the topboard held open in the inclined position, wherein the holding means has a holding member which is provided on a periphery of the reflection preventer body such that the holding member extends along the periphery, so as to hold the periphery in a state extending around-onto a lower surface of the topboard rear and/or a lower surface of the topboard front.

5. A topboard reflection preventer for a grand piano, which is attached to an openable and closable topboard formed by a topboard rear and a topboard front, so as to prevent lighting from above from being reflected by the topboard in a state in which the topboard is held open in an inclined position, comprising:

a reflection preventer body configured to be attached to the topboard rear and the topboard front folded onto the topboard rear, in a state covering whole upper surfaces of the topboard rear and the topboard front; and holding means configured to hold the reflection preventer body so as to prevent the reflection preventer body from falling off when the topboard held open in the inclined position and, wherein the holding means has a latch member which is attached to a predetermined portion of the reflection preventer body, and is locked to a locking portion formed on the lower surface of the topboard rear, in a state extending from above onto the lower surface of the topboard rear.

6. The topboard reflection preventer according to claim 5, wherein the reflection preventer body includes:

a topboard rear cover section configured to cover the upper surface of the topboard rear, and a topboard front cover section integrally formed with the topboard rear cover section and configured to cover the upper surface of the topboard front folded onto the topboard rear.

7. The topboard reflection preventer according to claim 6, wherein the topboard rear cover section has a shape substantially the same as a shape of the upper surface of the topboard rear, and wherein the topboard front cover section has a shape substantially the same as a shape of the upper surface of the topboard front and is formed such that the topboard front cover section is continuous with a right front end of the topboard rear cover section and extends rightward.

* * * * *